United States Patent [19]

Stark et al.

[11] Patent Number: 4,949,993

[45] Date of Patent: Aug. 21, 1990

[54] EXERCISE APPARATUS HAVING HIGH DURABILITY MECHANISM FOR USER ENERGY TRANSMISSION

[75] Inventors: Duane P. Stark; Michael T. Sweeney, both of Laguna Beach, Calif.

[73] Assignee: Laguna Tectrix, Inc., Irvine, Calif.

[21] Appl. No.: 387,936

[22] Filed: Jul. 31, 1989

[51] Int. Cl.[5] ..... A63B 23/00

[52] U.S. Cl. ..... 272/70; 272/69

[58] Field of Search ..... 272/70, 71, 72, 73, 272/118, 69, 128, 94, 96, 131, 132, 133

[56] References Cited

U.S. PATENT DOCUMENTS 3,970,302 7/1976 McFee ..... 272/130

4,708,338 11/1987 Potts ..... 272/70

4,720,093 1/1988 Del Mar ..... 272/70

*Primary Examiner*—Stephen R. Crow

*Attorney, Agent, or Firm*—Thomas J. Plante

[57] ABSTRACT

An exercising apparatus is disclosed which simulates stair-climbing. In order to reduce breakage problems in the force-transmitting structure between each pedal and a one-way rotating drive shaft, a pair of pulley wheels, each associated with a pair of cables, are used. Each pulley wheel rotates the drive shaft, and is pulled in one direction of rotation by a pedal-connected cable, and in the other direction of rotation by a cable connected to a return spring. Each cable on each pulley wheel reels into and out of helical grooves formed in the periphery of the pulley wheel.

10 Claims, 7 Drawing Sheets

EXERCISE APPARATUS HAVING HIGH DURABILITY MECHANISM FOR USER ENERGY TRANSMISSION

BACKGROUND OF THE INVENTION

This invention relates to exercise apparatus of the type in which (a) the exercise force on a user-operated member produces a substantially linear force which requires conversion into a rotary driving torque, and (b) the user-operated member is returned to a given position by an automatic retraction force. The primary example of such an exercise apparatus is one which simulates stair climbing In common assignee application Ser. No. 289,563, filed Dec. 23, 1988, and also in Pat. No. 4,708,338, referred to in the "Background" portion of Ser. No. 289,563, an apparatus is described having two foot pedals which cause rotation of a torque transmission member under the weight of the user as such weight is alternately placed on each pedal, driving it from its upper position to its lower position. There are, essentially, two portions of the force-transmitting system in such an apparatus. The first portion converts the downward pressure on each pedal into a one-way torque which turns a large diameter sprocket wheel. The second portion conveys the torque from the large diameter sprocket wheel to a small diameter sprocket wheel, which is on a shaft driving a variable resistance brake.

In the apparatus described above, each portion of the force transmitting system comprises sprocket wheels and a roller, or sprocket, chain. The pin-supported rollers on each roller chain mesh with teeth of the sprocket wheel(s), providing a positive (non-slipping) force-transmitting connection. The first portion of the force transmitting system comprises, at each pedal, a roller chain which is connected at one end to the pedal, which engages a sprocket wheel, and which is connected at the other end to an anchored retracting spring Each pedal-driven sprocket wheel operates through a one-way roller clutch to convert downward pressure on the pedal into torque rotating a shaft in a single direction. The shaft drives the large diameter sprocket wheel of the second portion of the force transmitting system.

Although the larger and smaller sprocket wheels and roller chain in the second portion of the force-transmitting system have functioned successfully, the sprocket chain connecting the pedal to the return spring has exhibited serious tendencies to break under operating stress. In other words, lack of durability of this roller chain has been a significant source of apparatus breakdowns, necessitating parts replacement and causing substantial down time of the apparatus.

It appears that many of such roller chain failures are caused by lateral stresses on the links of the chain, which are not designed to resist significant lateral forces. Any misalignment between portions of the chain adds such lateral bending stress to the tension force for which the chains are designed.

Also erosion (excessive wear) of the chain elements appears to be a factor. Whereas the roller chain in the second portion of the force-transmitting system is fully covered and protected by a shroud, such protection of the roller chain in the first portion of the force-transmitting system is impossible, because the pedal-connected end of each chain is exposed Various eroding substances, such as dirt adhering to the greased chain elements, or perspiration of the users, are inevitably collected on the chain elements.

Another source of potential failure in the sprocket wheel/roller chain combination is "freezing-up", or locking, of chain connecting pins, due to contaminating substances. Such locking can cause breakage of sprocket wheel teeth, because the chain does not properly engage the sprocket teeth.

Particularly in cases where stair climbers, or similarly operated exercise devises, are used in fitness clubs, durability is a major requirement And the inability of a device to operate due to sprocket chain or sprocket wheel failure creates significant annoyances.

SUMMARY OF THE INVENTION

The present invention uses a cable and pulley wheel mechanism as the first portion of the force transmitting system.

In the preferred embodiment, two cables and one pulley wheel are used at each pedal drive. The first cable of each pedal drive has one end connected to a pedal-supporting movable arm, and the other end anchored to a pulley wheel, which rotates in one direction under tension transmitted by the first cable The second cable of the same pedal drive has one end connected to a retracting element (such as a spring), and the other end anchored to the same pulley wheel. The second cable transmits tension force which urges the pulley wheel to rotate in the opposite direction, i.e., in the return direction.

Cable-guiding helical grooves (or threads) are provided in the periphery of each pulley wheel, in order to insure that a controlled wrapping action of each cable occurs as the length of its lay is shortened. In other words, as one cable is moving the pulley wheel, it unwinds from the grooves, and the other cable winds into the grooves. Preferably a continuous helical groove guides the wrapping and unwrapping of both cables. A preferred dimensional relationship is established between the cable diameter and thread diameter (i.e., the diameter across the pulley wheel between the inner surfaces of opposite grooves). Also a preferred dimensional relationship is maintained between the cable diameter and the width of the pulley wheel grooves.

DETAILED DESCRIPTION OF PREFERRED EMBODIMENT

Figure 1:
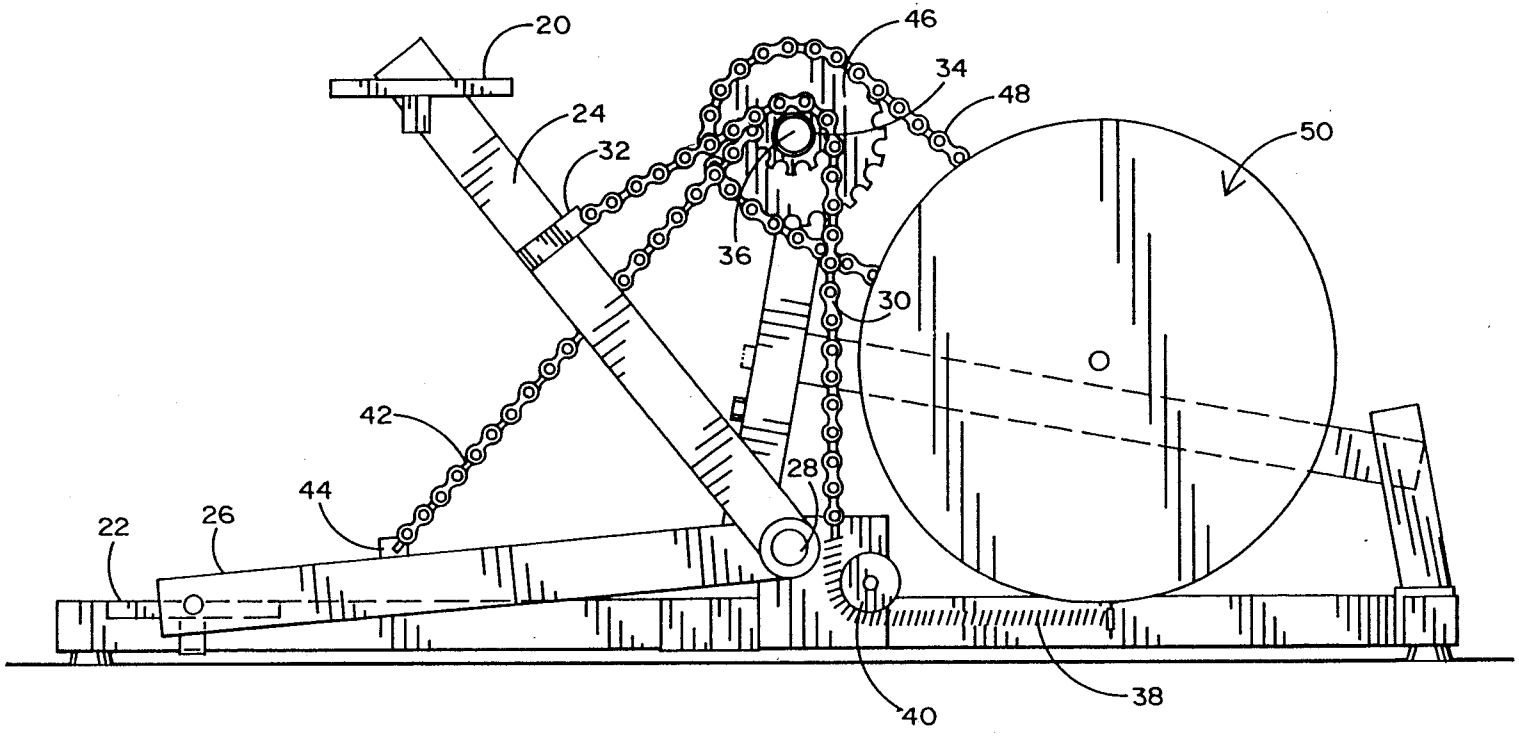
FIG. 1 (PRIOR ART)
FIG. 1 is a side view showing the prior structures in which breakage problems have been encountered.
Figure 2:
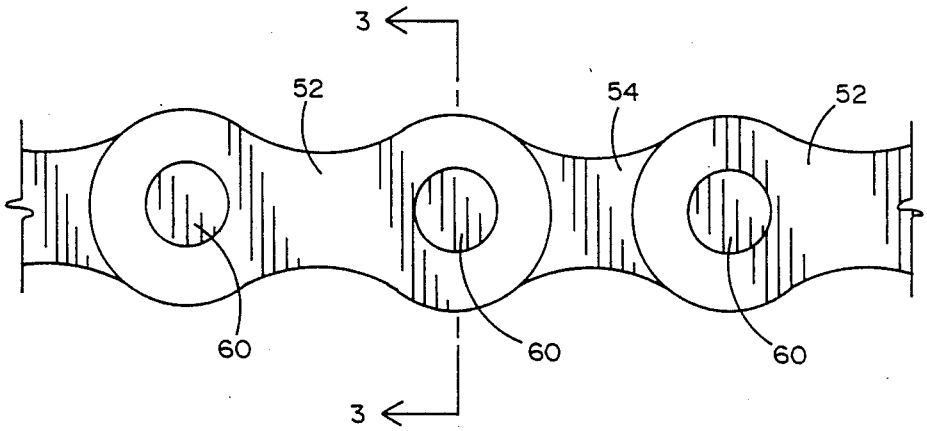
FIG. 2 (PRIOR ART)
FIG. 2 is a side view of a short length of the roller chain of FIG. 1.
Figure 3:
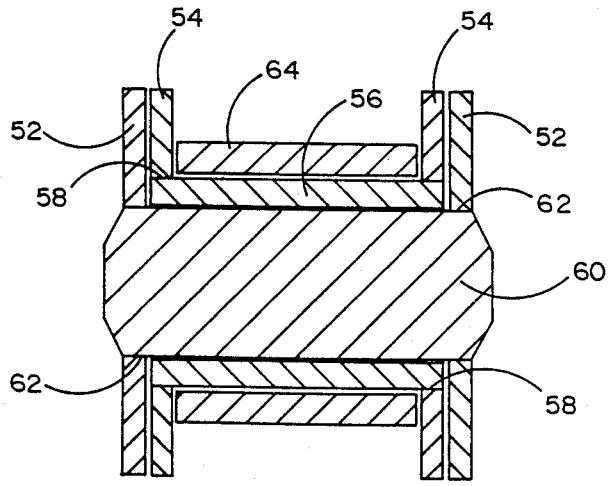
FIG. 3 (PRIOR ART)
FIG. 3 is a cross-section taken on the line 3—3 of FIG. 2.

In order to provide a clear understanding of the prior art problems, which motivated the development of the present invention, FIGS. 1–3 show the prior art sprocket wheel and roller chain arrangement for transmitting user-created force to a drive shaft, which shaft in turn causes rotation of a resistance mechanism, such as a friction brake, or an electrodynamic brake.

As seen in FIG. 1, two pedals are provided, on which the user can alternatively lift his/her body by stepping up with the right foot on a pedal 20, and then stepping up with the left foot on a pedal 22. The pedals 20 and 22 are pivotally mounted on crank arms 24 and 26, respectively; and the other ends of arms 24 and 26 are pivotally mounted on a shaft 28. As each crank arm 24 and 26 is moved downwardly, in turn, by the user's weight, its pedal moves along an arc centered at shaft 28. When the user's weight is transferred from one pedal to the other, the unloaded crank arm is returned to its upper position by a suitable return device, such as a spring, or a weight. The motion of the two pedals is independent reciprocating motion along an arcuate path.

In FIG. 1, pedal 20 is shown in its upper position. A roller chain 30 is attached to its crank arm 24 at a bracket, or anchor, 32 mounted on arm 24 and located near pedal 20. Roller chain 30 engages, and is wrapped around, a sprocket wheel 34, which is mounted on a one-way drive shaft 36. The end of chain 30 remote from bracket 32 is attached to a spring 38, which is anchored to the frame of the apparatus, and which is wrapped around an idler pulley 40. With pedal 20 in its uppermost position, spring 38, a tension (extension) spring, is in its least extended position. It has just returned pedal 20 to its uppermost position, ready for the user's weight to be shifted to pedal 20.

Pedal 22 is shown in its lower position, to which the weight of the user's body, supported on the user's left foot, has driven it. A roller chain 42 is attached to its crank arm 26 at a bracket, or anchor, 44 located near pedal 22. Roller chain 42 engages, and is wrapped around, a sprocket wheel (not shown), which is mounted on the same drive shaft 36 as sprocket wheel 34.

The end of roller chain 42 remote from bracket 44 is attached to a spring (not shown), which is anchored to the frame of the apparatus, and which is wrapped around an idler pulley. With pedal 22 in its lowermost position, its retraction spring, a tension spring, is in its fully extended position. It is ready to return pedal 22 to its uppermost position, as soon as the user's weight is removed from pedal 22.

In order for the apparatus to resist the user's weight sufficiently to permit the user to lift his/her body alternately with the left and right legs, an adequate resistance must oppose the downward motion of each pedal 20 and 22. A single resistance system is adequate, because each of the sprocket wheels is arranged to rotate drive shaft 36 by means of a one-way (freewheeling) clutch. Drive shaft 36 is rotated by its sprocket wheels only in a counterclockwise direction, as shown in FIG. 1. When either pedal 20 or 22 moves downwardly, it causes its one-way clutch to rotate shaft 36 in the same direction. When either pedal is moving upwardly, its one-way clutch transfers no driving energy to shaft 36. Drive shaft 36 has secured thereto a large sprocket wheel 46. Rotation of sprocket wheel 46 drives a roller chain 48, which in turn drives a small sprocket wheel (not shown) which is secured to, and therefore causes rotation of, a flywheel 50.

The roller chain 48, which transmits torque from sprocket wheel 46 to flywheel 50, does not appear to have serious wear, or breakage, problems. It is not usually subjected to lateral stresses, because it can readily be aligned to extend along a straight line. Also, it is protected from ambient materials which might cause undue wear by a shroud covering the entire moving structure, except for the space in which the pedals 20 and 22, and their crank arms 24 and 26, move. Furthermore, the force transmitted by roller chain 48 is less than that transmitted by either of roller chains 30 or 42, because of different mechanical ratios.

The two roller chains 30 and 42 have encountered the wear and breakage problems described above. Solving the problem by roller chain redesign has not been feasible, because of the inherent nature of the roller chain structure. This is shown more clearly in FIGS. 2 and 3. As shown in those figures, a roller chain consists of alternating pairs of flat links, which are secured to one another by laterally extending pins. Two outer link plates 52 alternate with two inner link plates 54. The two inner plates 54 are secured rigidly together by bushings 56, each of which is press-fitted into aligned holes 58 formed in the inner plates. The two outer plates 52 are secured rigidly together by pins 60 which are press-fitted into aligned holes 62 formed in the outer plates. The front pin 60 of one pair of outer plates 52 extends through the rear bushing 56 of one pair of inner plates 54; and the front bushing 56 of the same pair of inner plates 54 encircles the rear pin 60 of another pair of outer plates 52.

Each pin and bushing interconnect one pair of inner links to one pair of outer links, and permit relative angular movement of the connected link pairs around the pin axis. A roller 64 encircles each bushing 56, for the purpose of providing friction-reducing engagement of the roller chain with the gear teeth of the sprocket wheel.

The relatively thin link plates 52 and 54 are not intended to resist significant lateral, or shearing, stress. Therefore, a misalignment problem will tend to cause link plate breakage. Also, as stated, corrosion caused by contaminants can accelerate chain wear; and such corrosion can cause breakage of sprocket wheel teeth if a bushing and pin connection locks up.

After experimenting with chain modifications, and with belts as chain substitutes, the efforts to solve the chain problems led to consideration of cables as the tension-transmitting elements.

Cables proved to have important advantages, although their adaptation to the stair-climber apparatus required several structural changes in that apparatus. If a sufficiently strong and flexible cable is used, its structure is inherently able to withstand lateral stress. A length of cable consists of a plurality of metal wires, which, in effect, constitute a "wire rope". A plurality of wires concentrically laid around a center wire constitute a strand. Typically the number of wires in a strand is 7, 19, or 37. A group of strands laid around a core constitutes a cable. The greater the number of wires in a strand or cable of a given diameter, the more flexibility it has.

In addition to the flexibility available in cable construction, the cable wires are encased in a protective covering, such as nylon, which prevents the wires from being exposed to potentially damaging contaminants.

Because the tension transmitted by a length of cable requires that it be secured at both ends, it is desirable to use two cables for each pedal in a stair climber. A first cable has one end secured to the pedal crank arm, and the other end secured to a pulley wheel. A second cable has one end secured to the same pulley wheel, and the other end secured to a spring (or other retraction device). A separate pulley wheel and two more cables are required for the other pedal. In theory, a single cable, anchored to a pulley wheel intermediate its ends, could move the pulley wheel in both the driving and returning direction. But such a structure would be much more difficult to fabricate.

Figure 4:
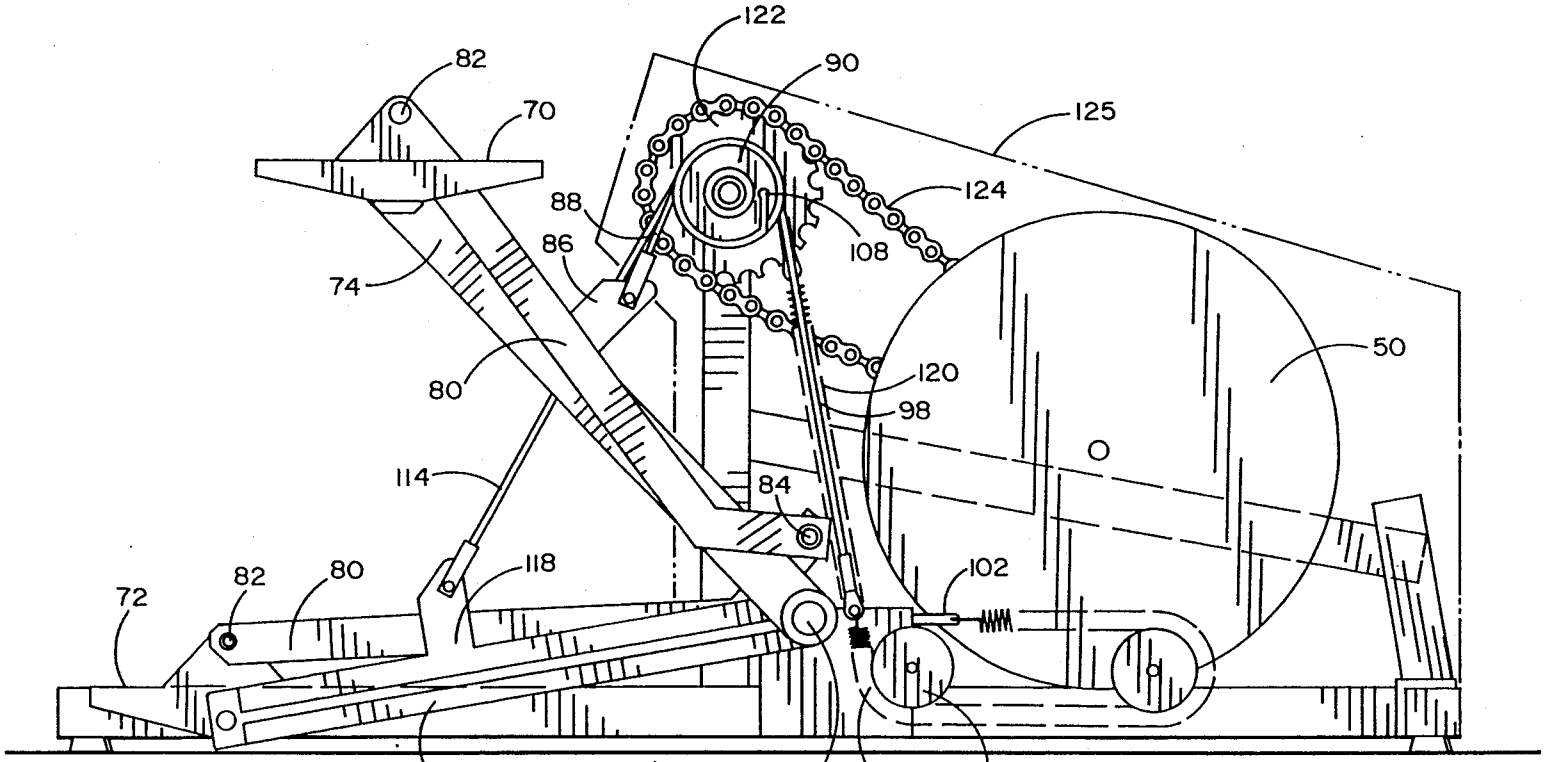
FIG. 4 is a side view showing the force transmitting mechanism which has solved the breakage problems associated with the structure of FIGS. 1–3.

FIG. 4 is a side view of a stair-climber apparatus having an improved mechanism for transmitting force from the pedals to a driving shaft. A right foot pedal 70 is shown in its upper position, ready to be pushed downwardly by the weight of the user. A left foot pedal 72 is shown in its lower position, ready to be returned to its upper position by a tension spring. Pedals 70 and 72 are pivotally supported on crank arms 74 and 76, respectively, which are both pivotally mounted on a non-rotating shaft 78 supported by the frame of the apparatus. Each pedal 70 and 72 also has a connecting link 80, which extends from a pivot 82 at the pedal to a pivot 84 on the frame. The two links 80 serve the purpose of maintaining the upper pedal surfaces in horizontal positions during the pivotal movements of crank arms 74 and 76.

Figure 6:
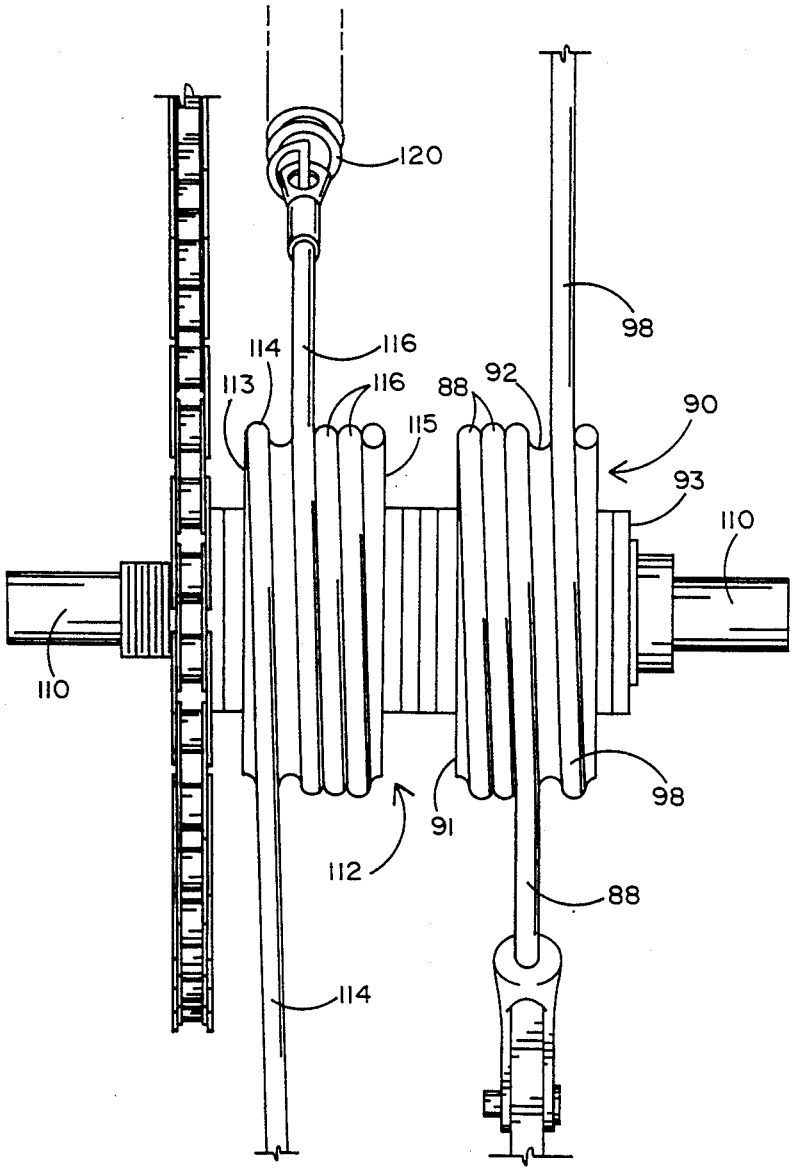
FIG. 6 is a plan view of the cable and pulley wheel structure of FIG. 5.

Crank arm 74 has a bracket 86, to which is connected one end of a cable 88. Cable 88 wraps around a pulley, or wheel, 90. As seen in FIG. 6, cable 88, as it wraps around pulley wheel 90, is guided in a continuous helical grove 92. (Grove 92 is seen more clearly in FIG. 7). The end of cable 88 is anchored to the left end 91 of pulley wheel 90 by means of a ball-shaped fitting which enters into a hole 94 (see FIG. 7) bored into, or through, pulley wheel 90. The end of cable 88 which terminates at the ball-shaped shaped fitting fits into a slot 96 extending from the pulley wheel periphery into the hole 94, which has a larger diameter than the slot 96. Because the ball end of the cable is larger in diameter than the slot 96, the ball anchors the cable end to the pulley wheel 90.

A second cable 98 has one end anchored to pulley wheel 90 and its other end connected to a tension spring 100 (FIG. 4). The spring is anchored at 102 on the apparatus frame. As shown, a lengthy spring is needed, which is wrapped around two widely-spaced pulleys 104 and 106, both carried by the frame. The length of the spring is dictated by the facts that (a) it must supply a high force, and (b) long spring life, therefore, requires extensive distribution of the spring flexing action. The second (spring-connected) cable 98 is anchored to the right end 93 of pulley wheel 90, (FIGS. 6 and 7), and it is visible in FIGS. 4 and 5. The same anchoring technique is used for cable 98, i.e., a ball-shaped fitting 108 secured to the cable end enters into the hole 94 bored through pulley wheel 90. Using a single bore 94 for the anchored ends of both cables 88 and 98 provides a manufacturing simplification.

Figure 5:
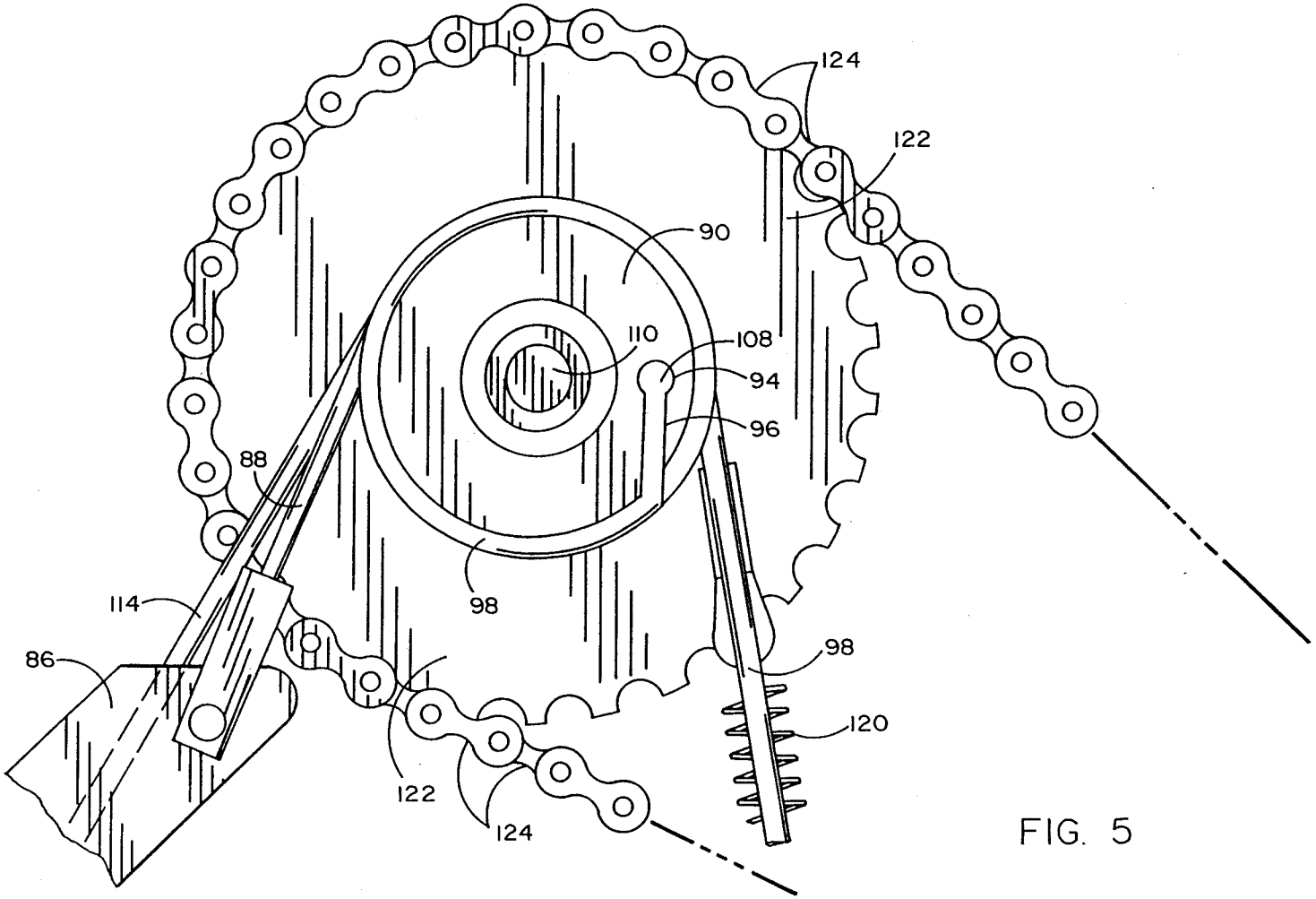
FIG. 5 is a close up of the cable and pulley wheel structure of FIG. 4.

Cable 88 exerts a pulling force on pulley wheel 90 which turns it in one direction (counterclockwise as seen in FIGS. 4 and 5). Cable 98 exerts a pulling force on pulley wheel 90 which turns it in the opposite direction (clockwise as seen in FIGS. 4 and 5). In FIG. 4, pedal 70 is in its upper position, to which it has been moved by the tension force of spring 100, which is in its least extended condition. As the user shifts his/her weight to the right foot, that weight forces pedal 70 downwardly, moving crank arm 74 in an arcuate direction around its pivot shaft 78. This pulls cable 88, unwinding it from the helical grooves 92 in pulley wheel 90. Inside pulley wheel 90 is located a one-way clutch 109 (FIG. 7) which causes the pulley wheel to rotate drive shaft 110 when pedal 70 is moving downwardly. This rotation of pulley wheel 90 causes cable 98 to wrap into the helical grooves 92 on the pulley wheel, causing extension of return spring 100.

After pedal 70 reaches its lower position, and the user's weight is removed and transferred to the other pedal 72, spring 100 will return pedal 70 to its upper position, rotating pulley wheel 90, but not rotating drive shaft 110, because of the free-wheeling aspect of the one-way clutch 109.

Left foot pedal 72 requires a separate pulley wheel 112 (FIGS. 6 and 7), and two cables 114 and 116 anchored to pulley wheel 112. The anchoring of the cables 114 and 116 to the pulley wheel 112 is accomplished in the same way as cables 88 and 98 are anchored to pulley wheel 90. Cable 114 has a ball-shaped end fitting anchored in the left end 113 of pulley wheel 112; and cable 116 has a ball-shaped end fitting anchored in the right end 115 of pulley wheel 112. One end of cable 114 is connected to a bracket 118 (FIG. 4) on crank arm 76, and its other end is anchored to pulley wheel 112. One end of cable 116 is connected to a spring 120, and its other end is anchored to pulley wheel 112.

Downward movement of pedal 72 under the user's weight causes rotation of pulley wheel 112 to rotate drive shaft 110, by means of a one-way clutch 117 (FIG. 7), in the same direction as shaft 110 is driven when pedal 70 is moved downwardly.

In the apparatus of FIGS. 4–7, the drive shaft 110 is in threaded engagement at 121 with a sprocket wheel 122. Rotation of sprocket wheel 122 causes rotation of flywheel 50 by a combination of sprocket wheels and roller chain of the type used for driving the flywheel 50 in FIG. 1. However, sprocket wheel 122 in FIGS. 4 and 5, which drives roller chain 124, needs to be somewhat larger in diameter than sprocket wheel 46 in FIG. 1, in order to maintain the same speed relationship between pedal motion and flywheel motion. This is true because the working diameter of pulley wheels 90 and 112 is larger than the working diameter of sprocket wheel 34 in FIG. 1. The increased diameter of the pulley wheels is needed to permit the required cable wrapping without undue lateral stresses in the cable. The larger diameter of the pulley wheels causes fewer turns of driving shaft 110 for a given amount of pedal motion.

Resistance to downward movement of the pedals 70 and 72 may be applied by a suitable braking mechanism. In one prior art system, the resistance is an electromagnetic (dynamic) brake. In common assignee application Ser. No. 289,563, the disclosure of which is incorporated herein by reference, the resistance is a band brake engaging the periphery of the flywheel, which is tightened and loosened by a motor, in order to maintain the desired flywheel speed.

Phantom line 125 in FIG. 4 shows the approximate location of a plastic shroud which covers as much of the operating mechanism as possible without interfering with pedal motion.

Figure 7:
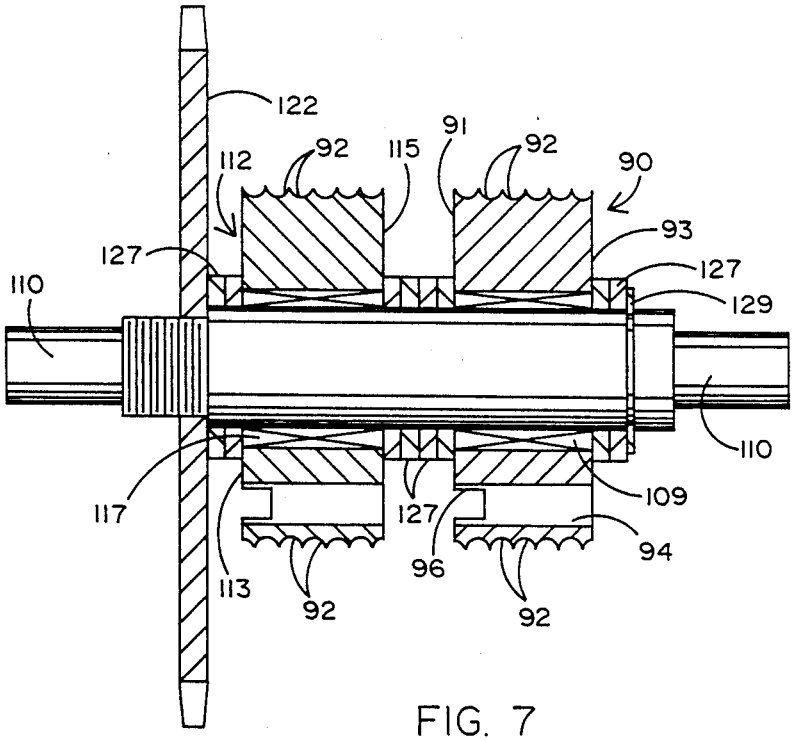
FIG. 7 is a cross-section taken through the pulley wheel and moving shaft of FIG. 6, but omitting the cable.

As shown in FIGS. 6 and 7, the driving shaft/-sprocket wheel/pulley wheel assembly may include a plurality of thrust washers 127, preferably made of bronze, which position the pulley wheels 90 and 112, and their one-way roller clutches 109 and 117. The washers 127 provide low friction engagement. A snap ring 129 near the right end of shaft 110 provides axial retention of the assembled parts at one end, and sprocket wheel 122 provides axial retention at the other end.

In addition to solving the breakage problem, the pulley system of the present invention provides smoother and quieter operation than the prior sprocket wheel/-roller chain combination. In a sprocket wheel/roller chain combination, each tooth-to-chain engagement creates a slight feel of roughness.

Figure 8:
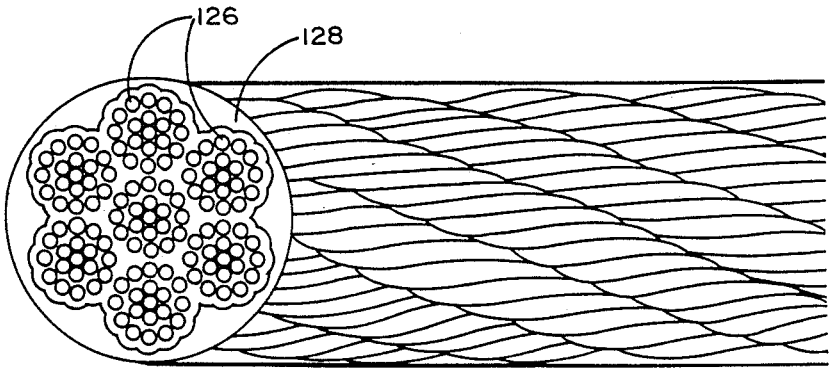
FIG. 8 is a greatly enlarged cross-section through the nylon-coated cable.

The cable advantages are enhanced by its protective covering, which is preferably nylon material. The cross-section and exterior of the preferred nylon-coated cable are shown in FIG. 8. The diameter of the wire cable is one-eighth inch, and the diameter including the nylon is three-sixteenths inch. The cable has seven strands, each of which includes nineteen wires 126. The wires are galvanized, and the strands are covered by a nylon jacket 128. This cable has a breaking strength of 2,000 pounds.

The recommended ratio of pulley wheel diameter to cable diameter is approximately 24 to 1. In the present usage, a pulley wheel diameter of three inches is combined with the cable diameter (wire strands) of one-eighth inch. This ratio of diameters, together with the number of wires, ensures long cable life by preventing undue lateral stressing as each cable winds (reels) into and out of the grooves on the periphery of each pulley wheel.

It was mentioned above that a high return spring force is required. The primary need for this force is to maintain each pedal in engagement with the user's foot as the foot is lifted. Obviously, faster user movements increase the demands on the return spring. A salutary second effect of the high return spring force is that it prevents the occurrence of slack in the cables as they unwind from their respective pulleys, i.e., it compensates for cable stretch.

Figure 9:
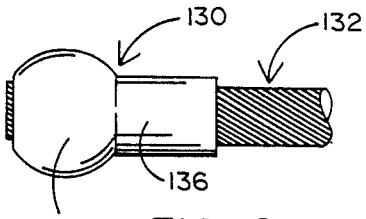
FIGS. 9–11 show end fittings used to secure each end of each cable to the appropriate connecting structures.

In order to maintain the desired strength and flexibility in the cable/pulley wheel system, certain cable end fittings are preferred. As shown in FIG. 9, the ball-end terminal fitting is a metal (preferably stainless steel) sleeve 130 swaged onto cable 132. The metal sleeve has a spherical portion 134 and an integral shank 136. The strength of this terminal fitting grip on the cable matches the breaking-strength of the cable itself. At the pulley wheels, the spherical portions 134 provide the anchoring engagement.

Figure 10:
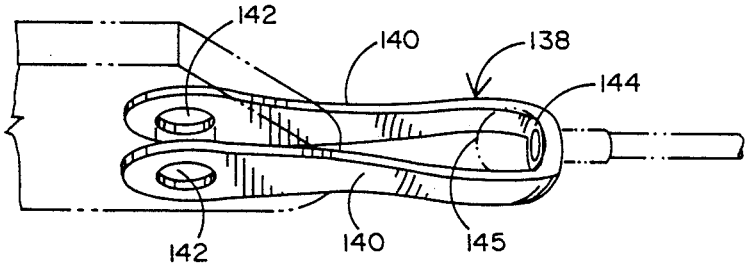
Figure 11:
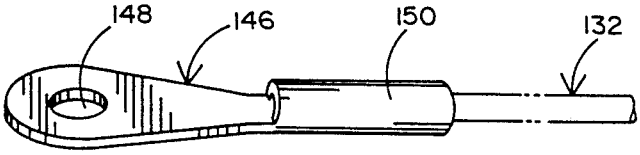

FIGS. 10 and 11 show the preferred connections at the pedal crank arms and at the return springs. FIG. 10 shows a strap fork/eye end which is pin-connected to the crank arm anchor. A folded steel strap 138 has two integral side plates 140, each of which has an opening 142 to receive a connecting pin Where the side plates 140 are joined, a spherical surface 144 is formed, against which a ball-end terminal engages (note phantom line 145). Thus the pedal to pulley wheel cable has a ball-end terminal at each end. The strap fork shown in FIG. 10 allows position-adjusting motion of the ball-end terminal with respect to surface 144.

As shown in FIG. 11, a fitting 146 is adequate for the spring end connection. The spring end extends through an eye 148, and an integral shank 150 is swaged onto the end of cable 132.

From the foregoing description, it will be apparent that the apparatus disclosed in this application will provide the significant functional benefits summarized in the introductory portion of the specification.

The following claims are intended not only to cover the specific embodiments and methods disclosed, but also to cover the inventive concepts explained herein with the maximum breadth and comprehensiveness permitted by the prior art.

What is claimed is:

1. In an exercise apparatus which simulates stair climbing, which has a rotating resistance mechanism, and means for causing rotation of said mechanism as a user steps alternately on a left foot pedal, moving it from an upper to a lower position, and a right foot pedal, moving it from an upper to a lower position, a force transmitting structure between the pedals and the resistance mechanism, comprising:

a driving shaft rotatable in one direction only;

a member which rotates with the driving shaft to cause rotation of the resistance mechanism;

a first pulley wheel mounted on the driving shaft and arranged to apply torque to the driving shaft when the first pulley wheel rotates in one direction, and to free wheel on the driving shaft when the first pulley wheel rotates in the opposite direction;

a first cable connected at one end to the left foot pedal and at the other end to the first pulley wheel, said first cable applying torque at the first pulley wheel to rotate the driving shaft when the left foot pedal is moved from its upper position to its lower position by the user's weight;

a first pedal-returning means for automatically returning the left pedal from its lower to its upper position when the user's weight is removed from that pedal;

a second cable connected at one end to the first pedal-returning means and at the other end to the first pulley wheel, said second cable applying torque to rotate that pulley wheel but not the driving shaft;

a second pulley wheel mounted on the driving shaft and arranged to apply torque to the driving shaft when the second pulley wheel rotates in one direction, and to free wheel on the driving shaft when the second pulley wheel rotates in the opposite direction;

a third cable connected at one end to the right foot pedal and at the other end to the second pulley wheel, said third cable applying torque at the second pulley wheel to rotate the driving shaft when the right foot pedal is moved from its upper position to its lower position by the user's weight;

a second pedal-returning means for automatically returning the right pedal from its lower to its upper position when the user's weight is removed from that pedal; and a fourth cable connected at one end to the second pedal-returning means and at the other end to the second pulley wheel, said fourth cable applying torque to rotate that pulley wheel but not the driving shaft.

2. The structure of claim 1 in which each of the cables is formed of:

a plurality of strands, each containing a plurality of wires; and a protective jacket formed of nylon or other plastic material.

3. The structure of claim 2 in which:

each of the pulley wheels has a diameter which is at least approximately twenty-four times the diameter of each cable.

4. The structure of claim 3 in which:

the collective diameter of the wire strands in each cable is approximately one-eighth inch;

the diameter of the protective jacket of each cable is approximately three-sixteenth inch; and the diameter of each pulley wheel is approximately three inches.

5. The structure of claim 1 in which:

each pulley wheel has helical grooves formed in its periphery, into which the cables wind and from which the cables unwind as the pulley rotates.

6. The structure of claim 5 in which:

each pulley wheel has a continuous helical groove formed in its periphery to guide the winding of both cables associated with that pulley wheel.

7. The structure of claim 5 in which:

each pulley wheel has formed in each of its ends an anchoring hole, and a smaller diameter slot leading from the helical groove to the anchoring hole; and each cable has an enlarged end fitting which fits into the anchoring hole at one end of the pulley wheel, in order to provide an anchoring connection between the cable and the pulley wheel.

8. The structure of claim 1 which also comprises:

a fitting at each cable to foot pedal connection which allows lateral motion of the cable without lateral stress on the cable.

9. The structure of claim 1 in which:

each of the pedal-returning means is a spring exerting a tension force on the cable to which it is connected.

10. In an exercise apparatus which simulates stair climbing, which has a rotating resistance mechanism, and means for causing rotation of said mechanism as a user steps alternately on a left foot pedal, moving it from an upper to a lower position, and a right foot pedal, moving it from an upper to a lower position, a force transmitting structure between the pedals and the resistance mechanism, comprising:

a driving shaft rotatable in one direction only;

a member which rotates with the driving shaft to cause rotation of the resistance mechanism;

a first pulley wheel mounted on the driving shaft and arranged to apply torque to the driving shaft when the first pulley wheel rotates in one direction, and to free wheel on the driving shaft when the first pulley wheel rotates in the opposite direction, said first pulley wheel applying torque to the driving shaft when the left pedal is moved from its upper position to its lower position by the user's weight;

a first pedal-returning means for automatically returning the left pedal from its lower to its upper position when the user's weight is removed from that pedal;

cable means connected to the left foot pedal and to the first pedal-returning means, and anchored to the first pulley wheel, in order to rotate that pulley wheel in both the driving and returning directions;

a second pulley wheel mounted on the driving shaft and arranged to apply torque to the driving shaft when the second pulley wheel rotates in one direction, and to free wheel on the driving shaft when the second pulley wheel rotates in the opposite direction, said second pulley wheel applying torque to the driving shaft when the right pedal is moved from its upper position to its lower position by the user's weight;

a second pedal-returning means for automatically returning the right pedal from its lower to its upper position when the user's weight is removed from that pedal; and cable means connected to the right foot pedal and to the second pedal-returning means, and anchored to the second pulley wheel, in order to rotate that pulley wheel in both the driving and returning directions.

* * * * *